US005167928A

United States Patent [19]

Kelly et al.

[11] Patent Number: 5,167,928

[45] Date of Patent: Dec. 1, 1992

[54] LABORATORY SHAKER APPARATUS

[76] Inventors: James P. Kelly, 111 E. Willow St., Beacon, N.Y. 12508; Texas Gehlhardt, 35 N. Lexow Ave., Nanuet; Keith Hoffer, Schwietzer La., Bardonia, both of N.Y. 10954

[21] Appl. No.: 465,898

[22] Filed: Jan. 16, 1990

[51] Int. Cl.[5] ..... B01L 9/00

[52] U.S. Cl. ..... 422/99; 422/101; 422/104; 366/208; 366/211; 366/212; 366/237; 211/70; 211/77; 211/81; 211/164

[58] Field of Search ..... 422/99, 101, 104, 116, 422/102; 366/208-212, 237, 240; 211/74, 164, 70, 77, 81, 60.1, 170

[56] References Cited

U.S. PATENT DOCUMENTS

| | | | |
|---|---|---|---|
| 379,055 | 3/1888 | Dancyger | 211/164 |
| 768,605 | 8/1904 | Keller et al. | 422/101 |
| 2,673,722 | 3/1954 | Griffin et al. | 366/212 |
| 3,516,801 | 6/1970 | Shah | 422/104 |
| 4,747,693 | 5/1988 | Kahl | 422/99 |
| 4,750,845 | 6/1988 | Nabetani | 366/208 |

FOREIGN PATENT DOCUMENTS

| | | | |
|---|---|---|---|
| 382219 | 2/1908 | France | 422/104 |

OTHER PUBLICATIONS

Fisher Scientific Catalog, 1988.

*Primary Examiner*—Robert J. Warden
*Assistant Examiner*—Laura E. Collins

[57] ABSTRACT

A shaker apparatus is provided for laboratory testing. The apparatus comprises a base that is reciprocally movable relative to a sub-base. A frame is mounted to the base and includes spaced apart vertical supports with a horizontal support assembly rotatably mounted therebetween. A plurality of test vessels are mounted to the horizontal support assembly and can be rotated with the horizontal support assembly 180° relative to the base. The vessels may be subjected to simultaneous shaking for identical periods of time. The horizontal frame assembly to which the vessels are mounted can be inverted between adjacent periods of shaking to permit selected refilling of the vessels, escape of gases therefrom and drainage of material from the vessels.

6 Claims, 3 Drawing Sheets

LABORATORY SHAKER APPARATUS

BACKGROUND OF THE INVENTION

Many laboratory processes require the shaking of aqueous solution and/or an aqueous solution combined with an immiscible organic solvent. The shaking generally must be controlled with respect to both intensity of agitation and duration to ensure meaningful comparisons of test results. Shaking often generates gases which must be vented from the container in which the solution is disposed. However, neither the shaking equipment nor the venting means should cause the controlled amount of aqueous solution and/or solvent to be splashed from the container.

Many laboratory testing procedures require an aqueous solution to be separated from an organic solvent after a predetermined duration of shaking. Additional organic solvent may then be added to the container having the residual aqueous solution therein. The controlled shaking may then be repeated. The end result of this testing procedure is the extraction of the solvent soluble organic compounds in the aqueous solution without creating an emulsion with the hydrophobic materials in the aqueous phase.

Efficient operation virtually requires the use of fairly large containers for these testing procedures. For example, one liter containers have been found to be desirable for many such testing procedures. Large containers are frequently required because the analytical measurement device, a GC/MS for example, requires high concentrations to ensure accurate detection. Similarly, reliability and reproducibility of test results make it desirable for several tests to be carried out, with the results of the tests being compared, averaged, or the like.

The prior art includes shakers intended for laboratory tests. The most practical prior art shakers for the above described testing procedures are floor-mounted shakers capable of holding and shaking up to four one liter laboratory vessels. This prior art shaker requires the vessels to be sequentially removed from the shaker to permit draining of the solvent and the addition of fresh solvent. The vessels must then be returned to the prior art shaker to repeat the shaking and subsequent draining process. This prior art shaker inherently requires very substantial times for the completion of such tests. Furthermore, the time consuming need to sequentially remove vessels from the prior art shaker yields very significant differences in time between the termination of the shaking and the drainage of solvent from one sample to the next. This results in different experimental findings for each sample.

In view of the above, it is an object of the subject invention to provide an improved laboratory shaker.

It is another object of the subject invention to provide a laboratory shaker that enables a plurality of samples to be shaken, vented and drained under nearly identical laboratory conditions.

An additional object of the subject invention is to provide a laboratory shaker that enables simultaneous shaking of a plurality of samples, and simultaneous inverting of the samples to permit drainage of solvent therefrom.

It is still another object of the invention to provide a laboratory shaker which can be installed in a conventional laboratory hood so that any possibly hazardous solvent vapors can be safely vented.

It is a further object of the subject invention to provide a shaker apparatus that permits secure retention and shaking of vessels in either an upright or inverted condition.

SUMMARY OF THE INVENTION

The subject invention is directed to a laboratory shaker that is operative to simultaneously shake a plurality of samples, to permit simultaneous and controlled venting of gases from the samples during shaking and to permit simultaneous inversion of the vessels in which the samples are shaken for controlled drainage of solvent therefrom.

The shaker apparatus comprises a frame having means for receiving a plurality of laboratory vessels therein. The laboratory vessels may be known vessels such as separatory funnels having opposed first and second ends, with a sealable opening at the first end and a stopcock valve at the opposed second end. The frame may comprise means for securely retaining the vessels to the frame. For example, the frame may comprise a vessel support into which a portion of each vessel is inserted and a finger clamp for retaining the vessels against the vessel support. The frame may be constructed to securely retain a plurality of vessels in a generally linear array.

The frame of the subject shaker apparatus further comprises rotary support means for inverting the vessels thereon. The rotary support means preferably is operative to permit simultaneous inversion of all vessels mounted thereto. In particular, the frame may comprise a pair of spaced apart vertical supports and a horizontal support assembly extending between the vertical supports and rotatable relative thereto. The horizontal support assembly may comprise the vessel support to which each vessel is mounted, and may further comprise the clamp means for securely retaining the vessels to the vessel support. The rotary support means may be operative to securely position the vessels in a plurality of different rotational and gravitational orientations relative to one another. For example, the rotatable support means may be operative to securely position the vessels into angular orientations separated from one another by approximately 180°. Thus the opposed first and second ends of the vessels may alternatively be positioned to define either the top or the bottom.

The shaker apparatus of the subject invention further comprises means for providing controlled shaking of at least a portion of the frame to which the vessels are mounted. In particular, at least a portion of the frame may be operatively connected to a motor for effecting a selected controlled shaking of the vessels mounted to the frame. In particular, the entire frame may be securely mounted to a base. The base may be mounted to a sub-base for controlled movement therebetween. A motor means may then be provided for generating the controlled movement between the base and the sub-base.

In operation, a plurality a vessels may be mounted to the respective supports on the frame and may be securely clamped thereto. The vessels, as noted above, preferably include a sealable opening at the first ends and stopcock valves at the opposed second ends. The stopcock valves are closed and the sealable vessels are mounted to the supports on the frame such that the vessel openings at the first ends are directed upwardly with the seals removed or otherwise disposed to permit filling of the vessels. A selected volume of an aqueous solution is poured into the respective vessels, and a immiscible organic solvent is added to the aqueous solution in the vessels. The openings in the first ends of the vessels are sealed and the rotatable portion of the frame is rotated 180° such that the vessel openings at the respective first ends are directed downwardly, and such that the stopcock valves at the respective second ends are directed upwardly. The stopcock valves may then be opened a selected amount to permit the escape of gases generated during shaking, and the motor means may be actuated to generate a selected intensity and duration of shaking. Gases generated in the vessels during shaking escape through the partly opened stopcock valves. After a selected duration of the shaking, the motor is stopped. The stopcock valves are shut and the rotatable portion of the frame is rotated 180°. The sealable openings and the stopcock valves at the respective first and second ends are again opened to permit organic solvent settled in the bottom of the vessels to be drained off into sample containers. The stopcock valves are then closed and additional solvent is added through the openings in the first ends of the respective vessels. The first end openings are resealed, the rotatable portion of the frame is inverted and the process is repeated. The subject apparatus enables considerable efficiencies and control in the above described testing process.

DETAILED DESCRIPTION OF THE PREFERRED EMBODIMENT

Figure 1:
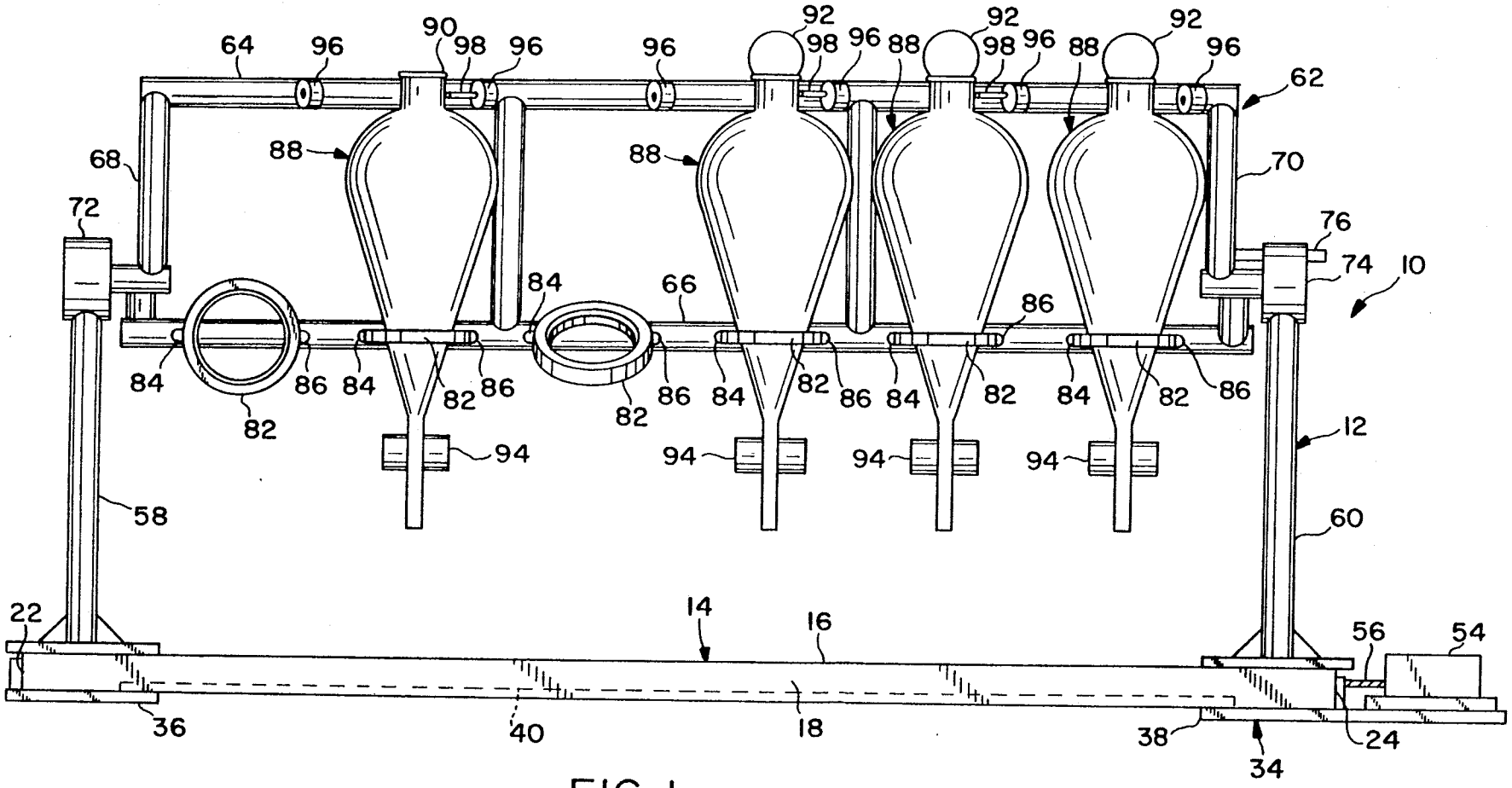
FIG. 1 is a front elevational view of a testing apparatus in accordance with the subject invention.

The testing apparatus of the subject invention is identified generally by the numeral 10 in FIGS. 1–4. The testing apparatus 10 comprises a frame 12 mounted to a base 14. The base 14 effectively defines an inverted tray having a generally planar top wall 16, opposed generally parallel front and rear walls 18 and 20 respectively extending orthogonally from the top wall 16, and a pair of opposed side walls 22 and 24 extending orthogonally from and connected to the top wall 16 and the front and rear walls 18 and 20. The front and rear walls 18 and 20 and the side walls 22 and 24 extend only a short distance from the top wall 16, and are provided primarily for dust protection and safety with respect to the movable components of the test apparatus 10.

The base 14 further comprises first and second front bearings 26 and 28 and first and second rear bearings 30 and 32. The bearings 26–32 are mounted to the underside of the top wall 16 and generally within the area enclosed by the front and rear walls 18 and 20 and the first and second side walls 22 and 24. More particularly, the first and second front bearings 26 and 28 are disposed in proximity to the front wall 18 and respectively in proximity to the first and second side walls 22 and 24. Similarly, the first and second rear bearings 30 and 32 are disposed in proximity to the rear wall 20 and the respective first and second side walls 22 and 24.

The test apparatus 10 further comprises a sub-base assembly identified generally by the numeral 34. The sub-base assembly 34 comprises a first sub-base 36 and a second sub-base 38 which are rigidly connected to one another by connecting member 40.

The sub-base assembly 34 comprises first and second front rails 46 and 48 which are disposed in generally co-linear relationship and which are securely mounted respectively to the first and second sub-bases 36 and 38. Similarly, the sub-base assembly 34 comprises first and second rear rails 50 and 52 which are disposed in generally co-linear relationship and which are mounted respectively to the first and second sub-bases 36 and 38. The rails 46–52 are disposed on the sub-base assembly 34 to respectively engage the bearings 26–32 of the base 14. In particular, the first and second front rails 46 and 48 are disposed t be in rolling engagement respectively with the first and second front bearings 26 and 28, while the first and second rear rails 50 and 52 are disposed to be in rolling engagement respectively with the first and second rear bearings 30 and 32. In this manner, the base 14 can be moved in a plane parallel to the top wall 16 and parallel to the front and rear walls 18 and 20 relative to the sub-base assembly 34.

The test apparatus 10 further comprises an electric motor 54 which is securely mounted to the second sub-base 38 of the sub-base assembly 34. The electric motor 54 is operatively engaged with the base 14 through a gear reducer 56. In particular, the motor 54, acting through the gear reducer 56 is operative to generate reciprocating movement of the base 14 relative to the sub-base assembly 34. Thus, the motor 54 causes the rolling interengagement between the bearings 26–32 and rails 46–52 respectively to generate an alternating generally planar linear movement. The motor 54 comprises known timing means for controlling the duration during which the alternating movement of the base 14 relative to the sub-base assembly 34 is carried out. The motor 54 further comprises a known speed adjustment means to adjust the speed of shaking in accordance with the requirements of a particular test. In most situations, however, the motor 54 will be set to operate at a fairly low speed to achieve a gentle agitation as part of the test.

Figure 4:
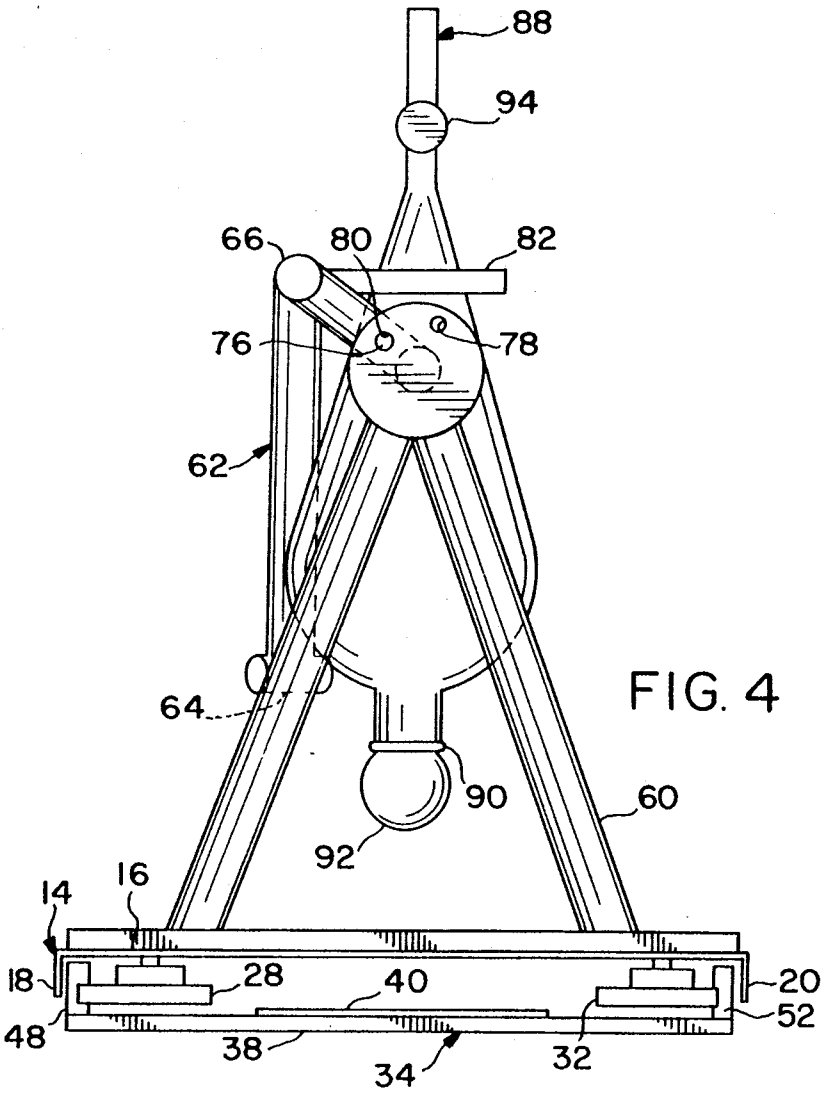
FIG. 4 is a side elevational view of the apparatus shown in a second operational position.
Figure 3:
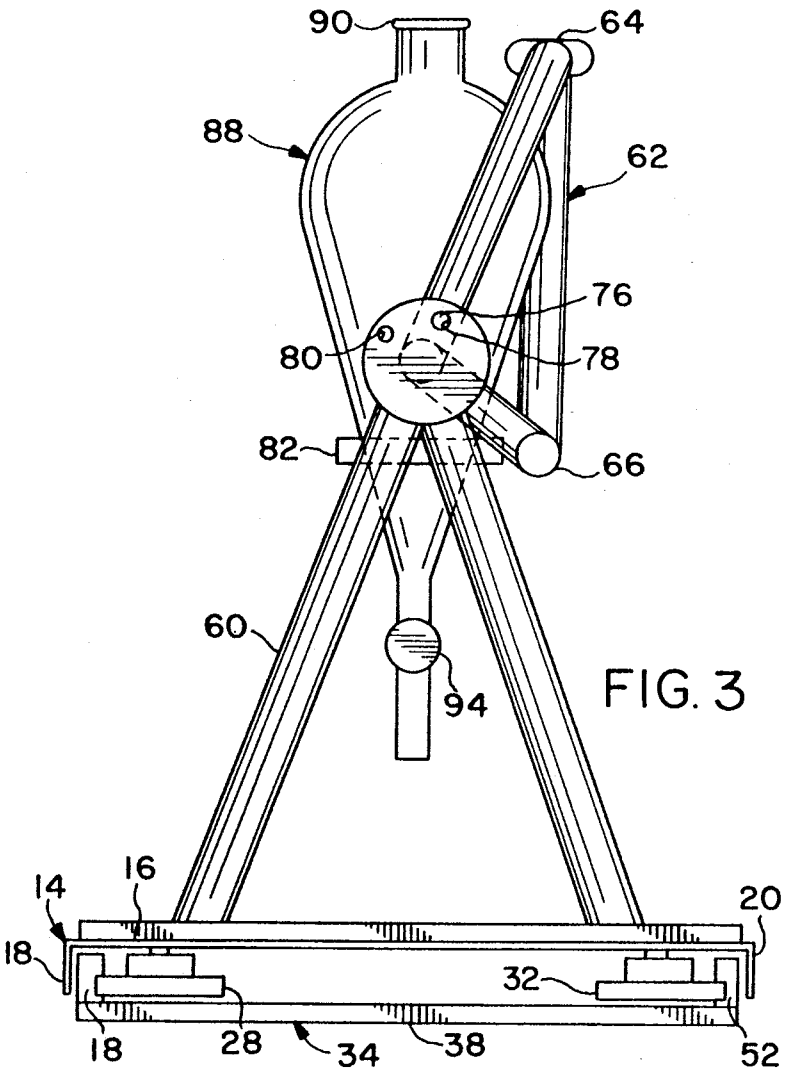
FIG. 3 is a side elevational view of the testing apparatus in a first operational position.

The frame 12 of the test apparatus 10 is rigidly mounted to the top wall 16 of the base 14. In particular, the frame 12 comprises a pair of spaced apart generally vertically aligned supports 58 and 60 which are rigidly mounted to the top wall 16 of the base 14. The frame 12 further comprises a horizontal support assembly 62 which extends generally horizontally between the vertical supports 58 and 60 and is rotatably mounted thereto. In particular, the horizontal support assembly 62 comprises first and second horizontal support tubes 64 and 66 which are retained in parallel relationship by end supports 68 and 70 which are rotatably mounted to the top bearings 72 and 74 of the vertical supports 58 and 60 respectively. The mounting of the horizontal support assembly 62 to the vertical supports 58 and 60 permits rotation of the horizontal support assembly 62 through at least 180°, and further permits locking of the horizontal support assembly 62 at rotational orientations separated by substantially 180°. Rotational locking is achieved by a locking pin 76 which is passed through apertures 78 or 80 as shown in FIGS. 3 and 4 and into an appropriate aperture in the horizontal support assembly 62. Thus, in a first locked orientation of the horizontal support assembly 62, relative to the vertical supports 58 and 60, the first horizontal support tube 64 is substantially directly above the second horizontal support tube 66. However, as shown in FIG. 4, the horizontal support assembly 62 can be locked in a second position relative to the vertical supports 58 and 60 such that the second horizontal tube 66 is directly above the first horizontal tube 64.

The second horizontal tube 66 includes a plurality of swivel washers 82 mounted thereto. In particular, each swivel washer 82 is rotatably mounted to support posts 84 and 86 which extend rigidly from the second horizontal support 66. The swivel washer 82 is dimensioned to receive a portion of a vessel 88. In particular, the vessel 88 comprises a first opened end 90 having an elastomeric stopper 92 securely retained therein in leakproof engagement. The vessel 88 further comprises a second end 94 defining a stopcock valve. The swivel washer 82 is dimensioned to receive a portion of the vessel 88 in proximity to the second end 94 such that the stopcock valve defining the second end 94 extends through the swivel washer 82.

The first horizontal tube 64 of the horizontal support assembly 62 comprises a plurality of clamp tubes 96 which are constructed to receive finger clamps 98 for selectively retaining portions of the vessels 88 in proximity to the first ends 90 thereof. The clamps 98 are operative to securely retain the vessels 88 in fixed relationship to the swivel washer 82 both in the first and second angular orientations of the horizontal support assembly 62. In particular, the horizontal support assembly 62 can be rotated from the FIG. 3 orientation with the first ends 90 of the vessels 88 being directed upwardly to the FIG. 4 orientation with the first ends 90 of the vessels 88 being directed downwardly and with the clamps 98 preventing the vessels 88 from disengaging from the horizontal support assembly 62.

Figure 2:
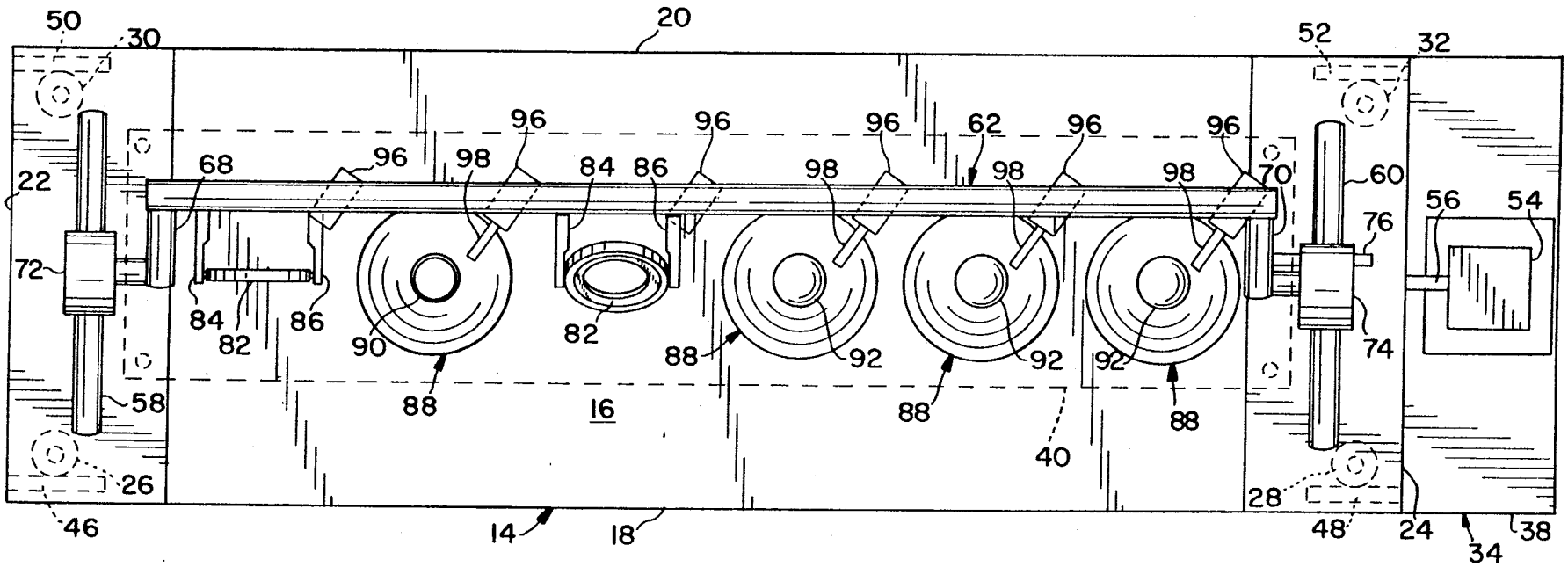
FIG. 2 is a top plan view of the testing apparatus.

The testing apparatus 10 shown in FIGS. 1–4 is employed by initially orienting the horizontal support assembly 62 into the first orientation as depicted in FIGS. 1–3. In this orientation the vessels 88 are mounted in the swivel washers 82 with the first ends 90 thereof being locked adjacent the first horizontal tube 64 by the clamps 98 passing through the clamp tubes 96. The stopcock valves at the respective first ends 94 of the vessels 88 are adjusted into the closed position and the caps 92 on the first ends 90 of the vessels 88 are removed. Approximately one liter of an appropriate aqueous solution is then poured into each respective vessel 88 through the opened upwardly directed first end 90. An appropriate amount of a selected immiscible organic solvent is then added into each of the respective vessels 88, also through the opened first end 90 thereof.

The test proceeds by tightly securing the rubber caps 92 to the first ends 90 of the respective vessels 88. The entire horizontal support assembly 62 is then rotated about location 72 and 74 on the vertical supports 58 and 60 into the second position shown most clearly in FIG. 4 and is locked in that position by passing the locking pin 76 through the aperture 80. In this orientation the second horizontal tube 66 is directly above the first horizontal tube 64, and the second end 94 of the vessel 82 having the stopcock valve thereon is directed upwardly. The caps 92 prevent the liquid from escaping through the first end 90 of the vessel 88, which, in the FIG. 4 orientation, is directed downwardly. The stopcock valve at the second end 94 is then opened a selected amount to permit the escape of gases that may be generated during the shaking. The motor 54 is then activated at a selected speed and for a selected time to subject the base 14 to reciprocal horizontal movement relative to the sub-base assembly 34. Gases generated by this agitation escape through the partially opened stopcock valve at the second end 94 of each respective vessel 88.

The motor 54 is manually or automatically stopped after a selected period of time. The stopcock valves at the second ends 94 are then closed and the locking pin 76 is removed from the aperture 80 to enable the horizontal support assembly 62 to be rotated 180° back to the orientation shown in FIGS. 1–3. It will be appreciated that this rotation of the horizontal support assembly 62 will simultaneously invert the various vessels 88 mounted to the horizontal support assembly 62. The organic solvent then settles to the bottom of the vessels 88 and is drained off each vessel 88 using the stopcock valves at the second ends 94 thereof, and into appropriate sample containers (not shown). The stopcock valves at the second ends 94 are then closed, and fresh solvent is added to each respective vessel 88 through the opened first end 90. The testing procedure may then be repeated. The end result is the extraction of the soluable organic compounds in the aqueous solution with the organic solvent without creating an emulsion with the hydrophobic materials in the aqueous phase.

In summary, a test apparatus is provided for efficient, reliable and simultaneous testing of a plurality of samples. The apparatus comprises a base which is reciprocally movable relative to a sub-base under the action of a controllable motor. A frame is mounted to the base and moves therewith. The frame comprises a horizontal support assembly that is rotatably mounted to two spaced apart vertical supports extending rigidly from the base. The horizontal support assembly can be rotated to two orientations substantially 180° apart. Vessels are removably mounted to the horizontal support assembly. Each vessel preferably comprises a stopcock valve at one end and a sealable opening at the opposed end. In a first orientation of the horizontal support assembly the stopcock valves are pointed downwardly, while in a second orientation of the horizontal support assembly the stopcock valves are pointed upwardly. The test vessels may be filled in one orientation of the horizontal support assembly and may be simultaneously shaken while the horizontal support assembly is in its second rotational orientation such that gases generated by the agitation can escape through the partially opened stopcock valves. The agitation can be stopped simultaneously and the vessels can be inverted simultaneously by merely rotating the horizontal support assembly back to its first orientation. Organic solvent that settles to the bottom of the vessels can be drained of using the stopcock valves, and additional solvent can be added to the tops of the vessels to enable a repeat of the tests.

While the invention has been described with respect to a preferred embodiment, it is apparent that various changes can be made without departing from the scope of the invention as defined by the appended claims.

We claim:

1. A shaker device for agitating a vessel containing a solution, the vessel having a first sealable opening into which the solution can enter the vessel and a second sealable opening from which the solution can exit the vessel, said shaker device comprising:

a sub-base;

a base moveably connected to said sub-base;

means for moving said base, relative to said sub-base, for providing agitation to a vessel;

a first support having a first portion fixedly mounted to a first location of said base and a second portion located above said base;

a second support having a first portion fixedly mounted to a second location of said base and a second portion located above said base; and vessel support means having a first end rotatably mounted to the second portion of said first support and a second end rotatably mounted to the second portion of said second support, said vessel support means for securely retaining the vessel thereto in a substantially upright position, said vessel support means further for rotating the vessel, about a generally horizontal axis relative to said base, 180° to position the vessel in a substantially upside-down position in order to allow a second opening of the vessel to be open during agitation to allow gases generated by the agitation of the solution to escape therethrough during agitation.

2. The shaker device of claim 1, said shaker device further comprising:

locking means for locking said vessel support means in the position where it is rotated 180° in order to retain the vessel in the substantially upside-down position during agitation.

3. The shaker device of claim 1, wherein said vessel support means comprises:

a first support piece having a first retaining mechanism to retain the vessel thereto at or near a first opening of the vessel; and a second support piece having a second retaining mechanism to retain the vessel thereto at or near the second opening of the vessel.

4. The shaker device of claim 3, wherein said first retaining mechanism comprises a clamp tube.

5. The shaker device of claim 3, wherein said second retaining mechansim comprises a washer.

6. The shaker device of claim 3, wherein said second retaining mechanism comprises:

a first support post having a first end fixedly mounted to said second support piece and a second end located outwardly therefrom;

a second support post having a first end fixedly mounted to said second support piece and a second end located outwardly therefrom; and a swivel washer rotatably mounted between the second ends of said first and second support posts.

* * * * *